US009576711B2

(12) United States Patent
Yoon et al.

(10) Patent No.: US 9,576,711 B2
(45) Date of Patent: Feb. 21, 2017

(54) COIL COMPONENT AND BOARD HAVING THE SAME

(71) Applicant: SAMSUNG ELECTRO-MECHANICS CO., LTD., Suwon-Si, Gyeonggi-Do (KR)

(72) Inventors: Chan Yoon, Suwon-Si (KR); Dong Hwan Lee, Suwon-Si (KR); Young Ghyu Ahn, Suwon-Si (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/625,297

(22) Filed: Feb. 18, 2015

(65) Prior Publication Data

US 2016/0078986 A1 Mar. 17, 2016

(30) Foreign Application Priority Data

Sep. 16, 2014 (KR) ..... 10-2014-0122895

(51) Int. Cl.

| | |
|---|---|
| ***H01F 27/28*** | (2006.01) |
| ***H01F 5/00*** | (2006.01) |
| ***H01F 5/04*** | (2006.01) |
| ***H01F 3/00*** | (2006.01) |
| ***H01F 17/00*** | (2006.01) |
| ***H01F 27/29*** | (2006.01) |

(52) U.S. Cl.

CPC *H01F 5/04* (2013.01); *H01F 3/00* (2013.01); *H01F 17/0013* (2013.01); *H01F 27/292* (2013.01); *H01F 2017/0066* (2013.01)

(58) Field of Classification Search

CPC ..... H01F 5/04; H01F 5/003; H01F 31/10; H01F 17/0006; H01F 17/0013; H01F 27/2804; H01F 3/00; H01F 27/292; H01F 2017/0066

USPC ..... 336/83, 222, 200, 182, 220, 170, 232

See application file for complete search history.

(56) References Cited

U.S. PATENT DOCUMENTS

| | | | | |
|---|---|---|---|---|
| 6,515,556 | B1 * | 2/2003 | Kato | H01P 5/185 333/116 |
| 2003/0134612 | A1 * | 7/2003 | Nakayama | H01F 17/0013 455/307 |
| 2007/0002513 | A1 | 1/2007 | Matsuoka et al. | |
| 2008/0048816 | A1 | 2/2008 | Matsumoto et al. | |
| 2012/0298407 | A1 * | 11/2012 | Ahn | H05K 1/111 174/260 |

FOREIGN PATENT DOCUMENTS

| | | | |
|---|---|---|---|
| JP | 2008-053613 | A | 3/2008 |
| KR | 10-2005-0011090 | A | 1/2005 |
| KR | 10-2007-0004462 | A | 1/2007 |

* cited by examiner

*Primary Examiner* — Mangtin Lian

(74) *Attorney, Agent, or Firm* — McDermott Will & Emery LLP

(57) ABSTRACT

There are provided a coil component and a board having the same. The coil component includes: a magnetic body including a substrate having two cores, first and second coil parts disposed on one surface of the substrate and wound in the same direction, and third and fourth coil parts disposed on the other surface of the substrate to be spaced apart from each other; and first to fourth external electrodes disposed on outer surfaces of the magnetic body and connected to the first to fourth coil parts.

14 Claims, 6 Drawing Sheets

COIL COMPONENT AND BOARD HAVING THE SAME

CROSS-REFERENCE TO RELATED APPLICATION

This application claims the priority and benefit of Korean Patent Application No. 10-2014-0122895 filed on Sep. 16, 2014, with the Korean Intellectual Property Office, the disclosure of which is incorporated herein by reference.

BACKGROUND

The present disclosure relates to a coil component and a board having the same.

Electronic products such as digital televisions, smartphones, and notebook computers, have commonly transmitted and received data in a high frequency (HF) band, and henceforth, it is expected that such information technology (IT) electronic products will be more frequently used in practical applications, since such devices are able to function independently and are also able to be connected to one another via universal serial bus (USB) or other communications ports to have multiple functions and high degrees of integration.

As smartphones have been developed, demand for highly efficient and highly functional small and thin power inductors able to operate at high levels of current has increased.

Therefore, currently, a 2016-sized product having a thickness of 1 mm has been used, instead of a 2520-sized product having a thickness of 1 mm commonly used in the past. Further, and it is expected that products will be further miniaturized to have 1608-size with a thickness of 0.8 mm.

Simultaneously, demand for an array having a reduced mounting area has also increased.

The array may have a coupled or non-coupled inductor form or a combination thereof, according to a coupling coefficient or mutual inductance between a plurality of coil parts.

Meanwhile, in a case in which a coupled inductor is able to decrease inductor current ripples while having the same output current ripples as those of a non-coupled inductor, the efficiency of an inductor array chip may be improved without increasing the size of a mounting area thereof.

In various applications, coupled inductors having a coupling coefficient of about 1.0 to 0.9 while having a certain degree of leakage inductance have been required, rather than non-coupled inductors.

Therefore, there is a need to manufacture an inductor array product capable of decreasing inductor current ripples by increasing a mutual inductance value while having a certain degree of leakage inductance that is not excessively low to decrease output current ripples.

RELATED ART DOCUMENT (Patent Document 1) Korean Patent Laid-Open Publication No. 2005-0011090

SUMMARY

An aspect of the present disclosure may provide a coil component and a board having the same.

According to an aspect of the present disclosure, a coil component may include a magnetic body including a substrate having two cores, first and second coil parts disposed on one surface of the substrate and wound in the same direction, and third and fourth coil parts disposed on the other surface of the substrate to be spaced apart from each other; and first to fourth external electrodes disposed on outer surfaces of the magnetic body and connected to the first to fourth coil parts.

According to another aspect of the present disclosure, a board having a coil component may include a printed circuit board on which a plurality of electrode pads are provided; and the coil component mounted on the printed circuit board, wherein the coil component includes a magnetic body including a substrate having two cores, first and second coil parts disposed on one surface of the substrate and wound in the same direction, and third and fourth coil parts disposed on the other surface of the substrate to be spaced apart from each other; and first to fourth external electrodes disposed on outer surfaces of the magnetic body and connected to the first to fourth coil parts.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
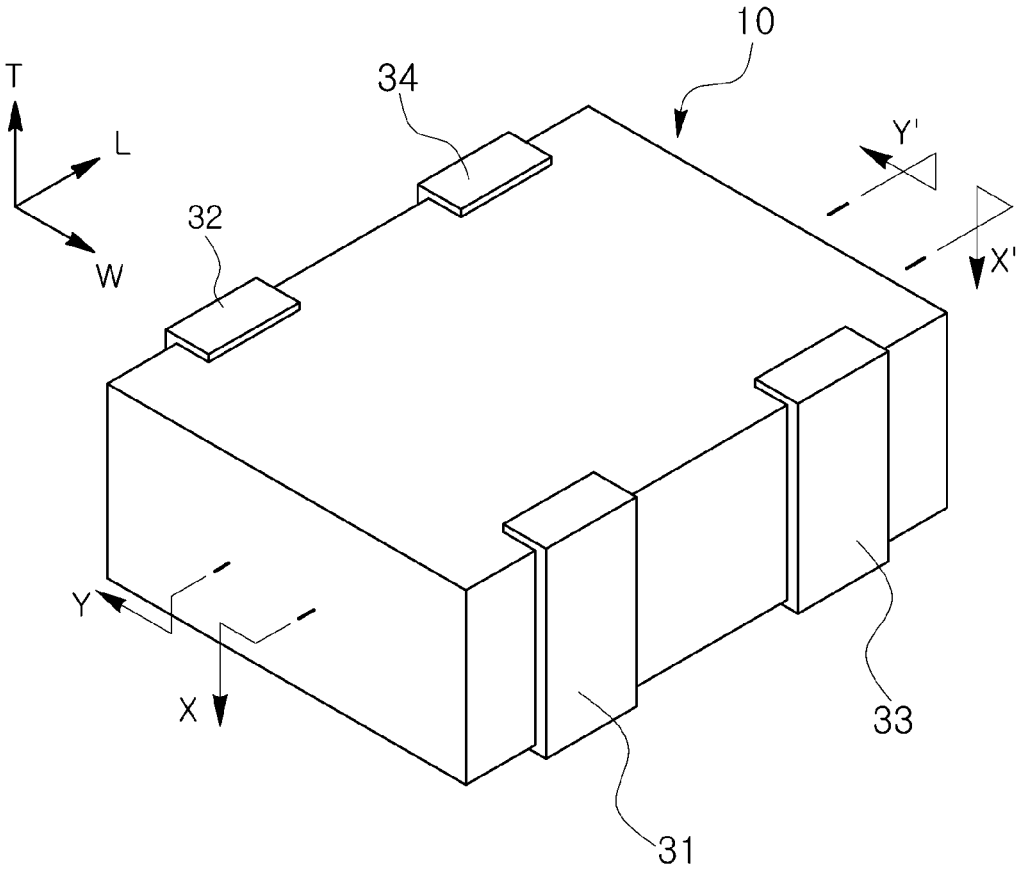
FIG. 1 is a perspective view of a coil component according to an exemplary embodiment in the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Coil Component

FIG. 1 is a perspective view of a coil component according to an exemplary embodiment in the present disclosure.

Figure 2:
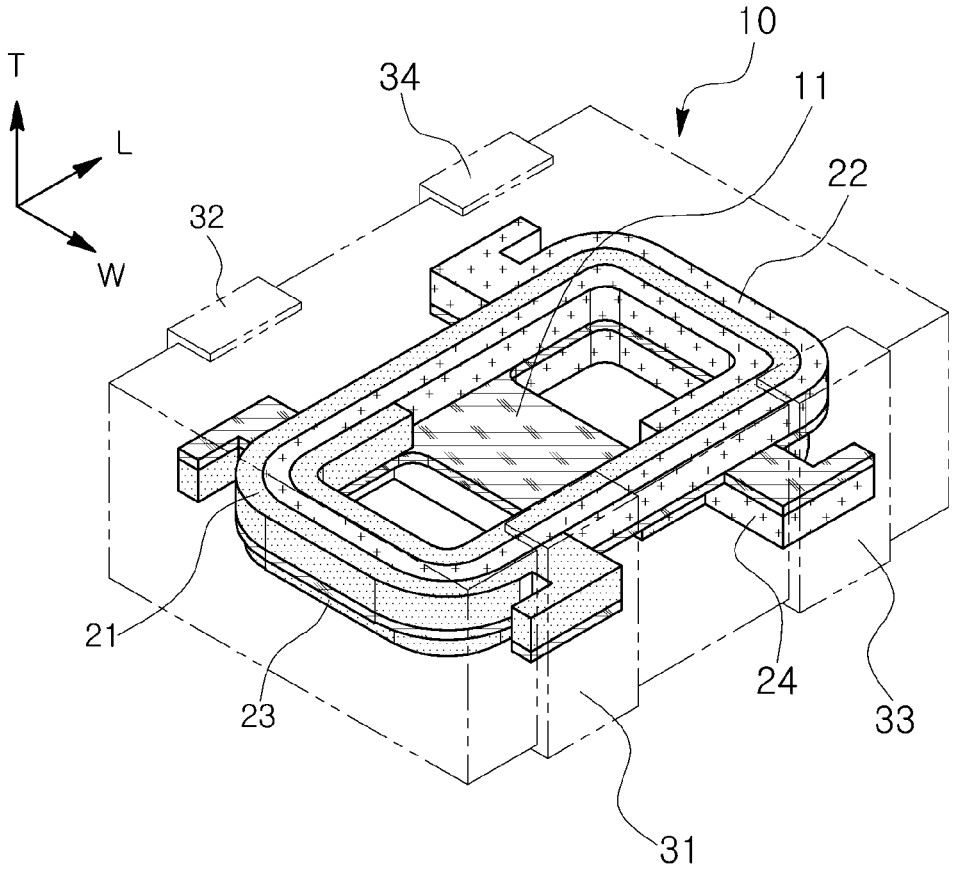
FIG. 2 is a perspective view of external electrodes and a magnetic body of the coil component according to an exemplary embodiment in the present disclosure.

FIG. 2 is a perspective view schematically illustrating the interior of the coil component according to the exemplary embodiment.

Referring to FIGS. 1 and 2, the coil component according to this exemplary embodiment may include a magnetic body 10 including a substrate 11 having two cores, first and second coil parts 21 and 22 disposed on one surface of the substrate 11 and wound in the same direction, and third and fourth coil parts 23 and 24 disposed on the other surface of the substrate 11 to be spaced apart from each other, and first to fourth external electrodes 31 to 34 disposed on outer surfaces of the magnetic body 10 and connected to the first to fourth coil parts 21 to 24.

Here, the terms "first" to "fourth" are used in order to distinguish corresponding elements from one another, regardless of the order of the corresponding elements.

The magnetic body 10 may be a hexahedron, and with regard to the directions of the magnetic body 10, an "L direction" may refer to a "length direction", a "W direction" may refer to a "width direction" and a "T direction" may refer to a "thickness direction".

The magnetic body 10 may include the substrate 11 having two cores and the first to fourth coil parts 21 to 24 disposed on and below the substrate 11 and enclosed by an insulation film.

The substrate 11 may be a magnetic substrate, and the magnetic substrate 11 may contain nickel-zinc-copper ferrite, but is not limited thereto.

In addition, the coil component according to an exemplary embodiment may include the first and third external electrodes 31 and 33 formed on one surface of the magnetic body 10 and the second and fourth external electrodes 32 and 34 formed on the other surface of the magnetic body 10 opposing one surface of the magnetic body 10.

Hereinafter, the first to fourth coil parts 21 to 24 and the first to fourth external electrodes 31 to 34 will be detailed.

Figure 3:
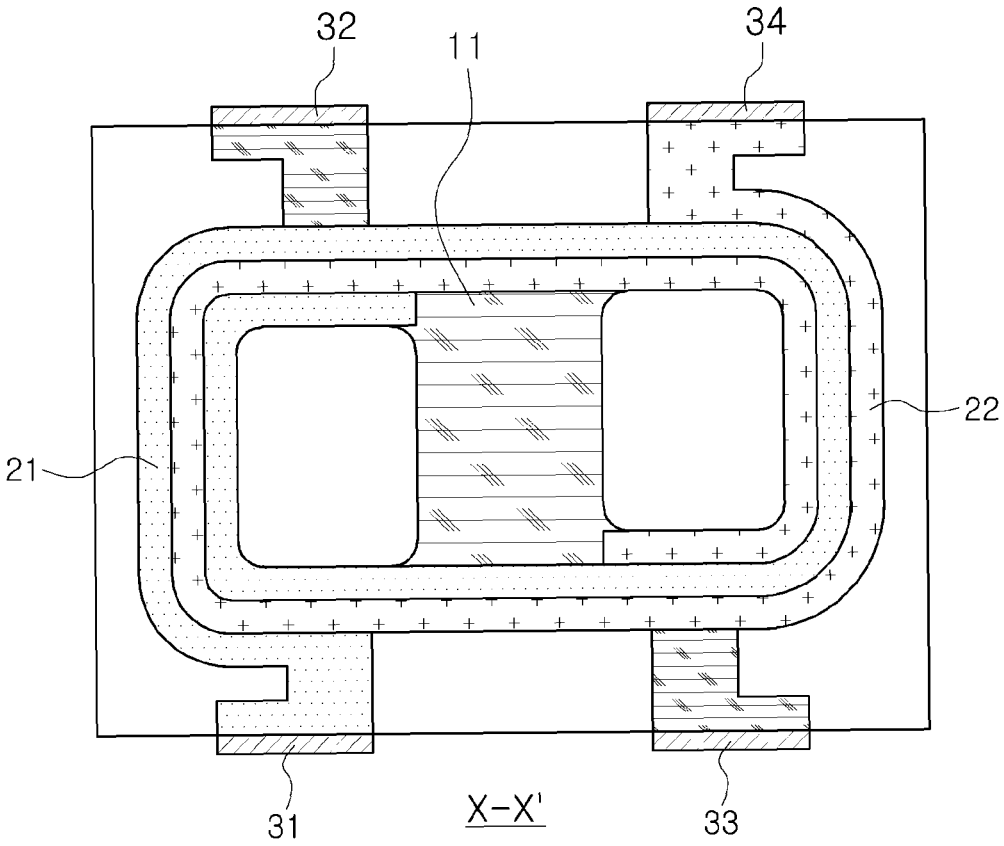
FIG. 3 is a cross-sectional view taken along line X-X' of FIG. 1.

FIG. 3 is a cross-sectional view taken along line X-X' of FIG. 1.

Figure 4:
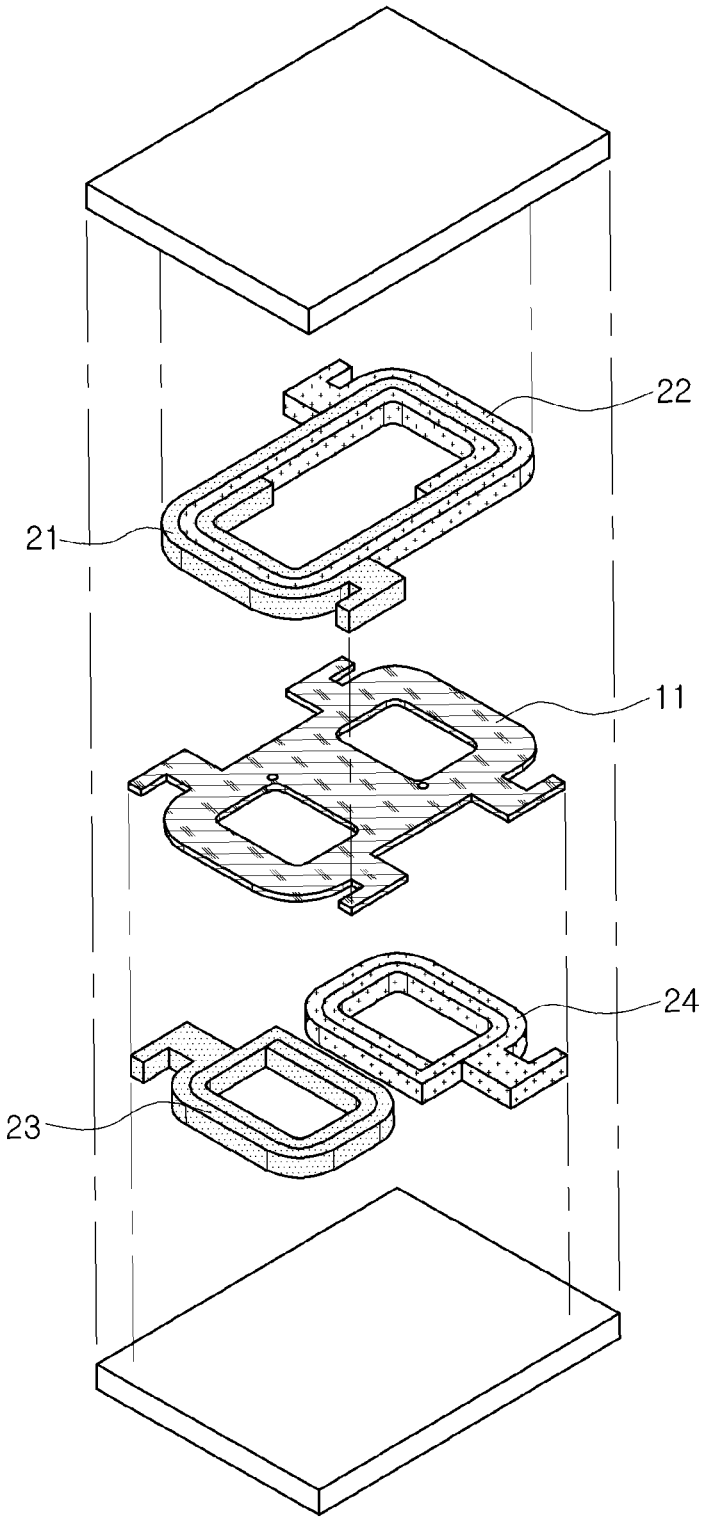
FIG. 4 is an exploded perspective view of FIG. 1.

FIG. 4 is an exploded perspective view of FIG. 1.

Figure 5:
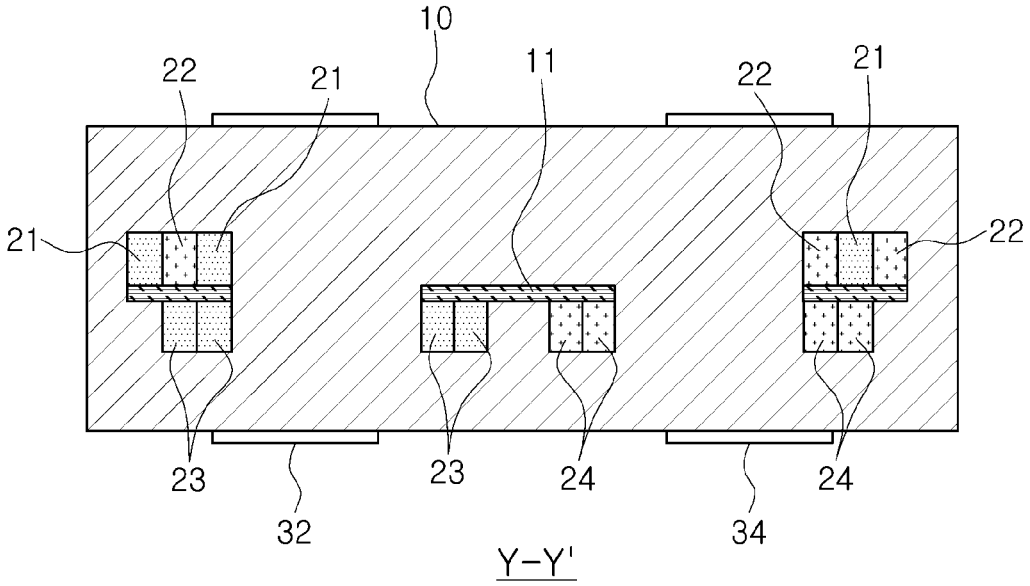
FIG. 5 is a cross-sectional view taken along line Y-Y' of FIG. 1.

FIG. 5 is a cross-sectional view taken along line Y-Y' of FIG. 1.

Referring to FIGS. 3 through 5, the first and second coil parts 21 and 22 may have a double coil shape in which two coils are disposed adjacent to each other on an upper surface of the substrate 11 while sharing the cores, and are wound adjacent to each other on the same plane in the same direction.

Further, the third and fourth coil parts 23 and 24 may be disposed in parallel to each other on a lower surface of the substrate 11 to be spaced apart from each other while being wound on the same plane to be spaced apart from each other in the length direction of the magnetic body 10.

The first and second coil parts 21 and 22 may be symmetrical to each other on the basis of the center of the magnetic body 10, and the third and fourth coil parts 23 and 24 may be symmetrical to each other on the basis of the center of the magnetic body 10.

The center of the third coil part 23 which is wound on the lower surface of the substrate and the center of the fourth coil part 24 which is wound on the lower surface of the substrate may be referred to as cores, respectively, and thus, the substrate 11 may have two cores.

According to an exemplary embodiment, the first and second coil parts 21 and 22 may be symmetrical to each other on the basis of the center of the magnetic body, such that the first and second coil parts 21 and 22 have the same inductance value, and the third and fourth coil parts 23 and 24 may be symmetrical to each other on the basis of the center of the magnetic body, such that the third and fourth coil parts 23 and 24 have the same inductance value.

In addition, one ends of the first and second coil parts 21 and 22 may be exposed to one surface and the other surface of the magnetic body 10 in the width direction thereof, respectively, and one ends of the third and fourth coil parts 23 and 24 may be exposed to one surface and the other surface of the magnetic body 10 in the width direction thereof, respectively, such that one ends of the first and second coil parts 21 and 22 and one ends of the third and fourth coil parts 23 and 24 may be connected to the first to fourth external electrodes 31 to 34, respectively.

That is, in a case in which one end of the first coil part 21 is exposed to a first surface of the magnetic body 10 in the width direction thereof, one end of the second coil part 22 wound with the first coil part 21 on the same plane in the same direction may be exposed to a second surface of the magnetic body 10 which opposes the first surface of the magnetic body 10 in the width direction thereof.

The exposed end of the first coil part 21 may be connected to the first external electrode 31, and the exposed end of the second coil part 22 may be connected to the fourth external electrode 34.

Further, the first and second coil parts 21 and 22 may be symmetrical to each other on the basis of the center of the magnetic body 10.

Due to the above-mentioned feature, the first and second coil parts 21 and 22 may have the same length as each other.

Similarly, one end of the third coil part 23 disposed on the lower surface of the substrate 11 may be exposed to the second surface of the magnetic body 10 in the width direction thereof while being spaced apart from the exposed end of the second coil part 22.

In addition, one end of the fourth coil part 24 disposed to be spaced apart from the third coil part 23 on the same plane may be exposed to the first surface of the magnetic body 10 opposing the second surface of the magnetic body 10 in the width direction thereof while being spaced apart from the exposed end of the first coil part 21.

The exposed end of the third coil part 23 may be connected to the second external electrode 32, and the exposed end of the fourth coil part 24 may be connected to the third external electrode 33.

In addition, the third and fourth coil parts 23 and 24 may have the same length.

As described above, the first to fourth coil parts 21 to 24 may be exposed to one surface and the other surface of the magnetic body 10 while being spaced apart from each other, such that the first to fourth coil parts 21 to 24 are connected to the first to fourth external electrodes 31 to 34, respectively.

The first and third external electrodes 31 and 33 may be input terminals, and the second and fourth external electrodes 32 and 34 may be output terminals, but the present inventive concept is not limited thereto.

Meanwhile, the first and second coil parts 21 and 22 may be formed on the same plane, which is the upper surface of the magnetic substrate 11, and the third and fourth coil parts 23 and 24 may be formed on the same plane, which is the lower surface of the magnetic substrate 11. In addition, the first and third coil parts 21 and 23 may be connected to each other through a via electrode (not shown).

Similarly, the second and fourth coil parts 22 and 24 may be connected to each other through a via electrode (not shown).

Therefore, a current input through the first external electrode 31, the input terminal, may pass through the first coil part 21, the via electrode, and the third coil part 23 to flow toward the second external electrode 32, the output terminal.

Similarly, a current input through the third external electrode 33, the input terminal, may pass through the fourth coil part 24, the via electrode, and the second coil part 22 to flow toward the fourth external electrode 34, the output terminal.

In the coil component according to the exemplary embodiment, two coils positioned in an upper portion of the magnetic body 10 on the basis of the center of the magnetic body 10 in the thickness direction thereof, that is, the first and second coil parts 21 and 22 are disposed adjacent to each other while sharing the cores, and thus, coupling coefficient may be increased.

That is, since the first and second coil parts 21 and 22 have a double coil shape in which they are wound adjacent to each other on the same plane, which is the upper surface of the substrate 11, in the same direction, the coil component may have a significantly large coupling coefficient value.

That is, the two coils may be disposed adjacent to each other while sharing the cores, and thus, the coil component may have a significantly large coupling coefficient value.

Further, two coils positioned on the lower surface of the substrate 11, that is, the third and fourth coil parts 23 and 24 may be disposed in parallel to each other while being spaced apart from each other, leakage inductance may be increased.

That is, the third and fourth coil parts 23 and 24 may be disposed in parallel to each other on the lower surface of the substrate 11 while being spaced apart from each other and may be wound on the same plane while being spaced apart from each other in the length direction of the magnetic body 10, leakage inductance may be increased similarly to the configuration of a non-coupled inductor.

Therefore, leakage inductance and mutual inductance may be adjusted to desired values.

The first to fourth coil parts 21 to 24 may contain at least one selected from the group consisting of gold, silver, platinum, copper, nickel, palladium, and alloys thereof.

The first to fourth coil parts 21 to 24 may be formed of any material as long as the material may impart conductivity to the coil parts, and the material of the coil parts is not limited to the above-mentioned metals.

Further, the first to fourth coil parts 21 to 24 may have a polygonal, circular, oval, or irregular shape, and the shape thereof is not particularly limited.

The first to fourth coil parts 21 to 24 may be connected to the first to fourth external electrodes 31 to 34 through lead terminals (not shown), respectively.

The external electrode may include the first to fourth external electrodes 31 to 34.

The first to fourth external electrodes 31 to 34 may be extended in the thickness direction ("T direction") of the magnetic body 10.

The first to fourth external electrodes 31 to 34 may be disposed to be spaced apart from each other to thereby be electrically isolated from each other.

The first to fourth external electrodes 31 to 34 may be extended to portions of the upper and lower surfaces of the magnetic body 10.

Since portions of the first to fourth external electrodes 31 to 34 bonded to the magnetic body 10 have an angled shape, adhesive force between the first to fourth external electrodes 31 to 34 and the magnetic body 10 may be improved, whereby impact resistance and the like may be improved.

A metal forming the first to fourth external electrodes 31 to 34 is not particularly limited as long as the metal may impart electrical conductivity to the first to fourth external electrodes 31 to 34.

More specifically, the first to fourth external electrodes 31 to 34 may contain at least one selected from the group consisting of gold, silver, platinum, copper, nickel, palladium, and alloys thereof.

Gold, silver, platinum, and palladium are expensive but are stable, while copper and nickel are inexpensive but may be oxidized during a sintering process to thereby decrease electrical conductivity.

A thickness of the magnetic body 10 may be 1.2 mm or less, but is not limited thereto. The thickness of the magnetic body 10 may be varied.

The following table 1 shows inductance and coupling coefficient values of a coil component according to an inventive example, a negatively coupled inductor according to comparative example 1, and a non-coupled inductor according to comparative example 2.

TABLE 1

| | Comparative Example 1 | Comparative Example 2 | Inventive Example |
|---|---|---|---|
| Inductance [μH] | 7.92 | 0.4841 | 0.2377 |
| Coupling Coefficient | −0.99677 | 0.064 | −0.42309 |

Referring to table 1, in the case of the negatively coupled inductor according to comparative example 1, coils were disposed adjacent to each other while sharing cores, the negatively coupled inductor had a significantly large coupling coefficient value of 0.9 or more.

On the contrary, in the case of the non-coupled inductor according to comparative example 2, two coils were almost not affected by magnetic fluxes, the non-coupled inductor had a significantly small coupling coefficient value of 0.1 or less.

In the coil component according to the inventive example, two coils positioned in an upper portion of a magnetic body on the basis of a central portion of the magnetic body were disposed adjacent to each other while sharing cores, thereby increasing coupling coefficient, while two coils positioned in a lower portion of the magnetic body were disposed to be spaced apart from each other, thereby significantly decreasing an influence of magnetic fluxes and increasing leakage inductance.

Therefore, leakage inductance and mutual inductance may be adjusted to desired values.

In table 1, as the coupling coefficient is closer to 1, the coupling coefficient is increased, and a (−) symbol refers to negative coupling.

Board Having Coil Component

Figure 6:
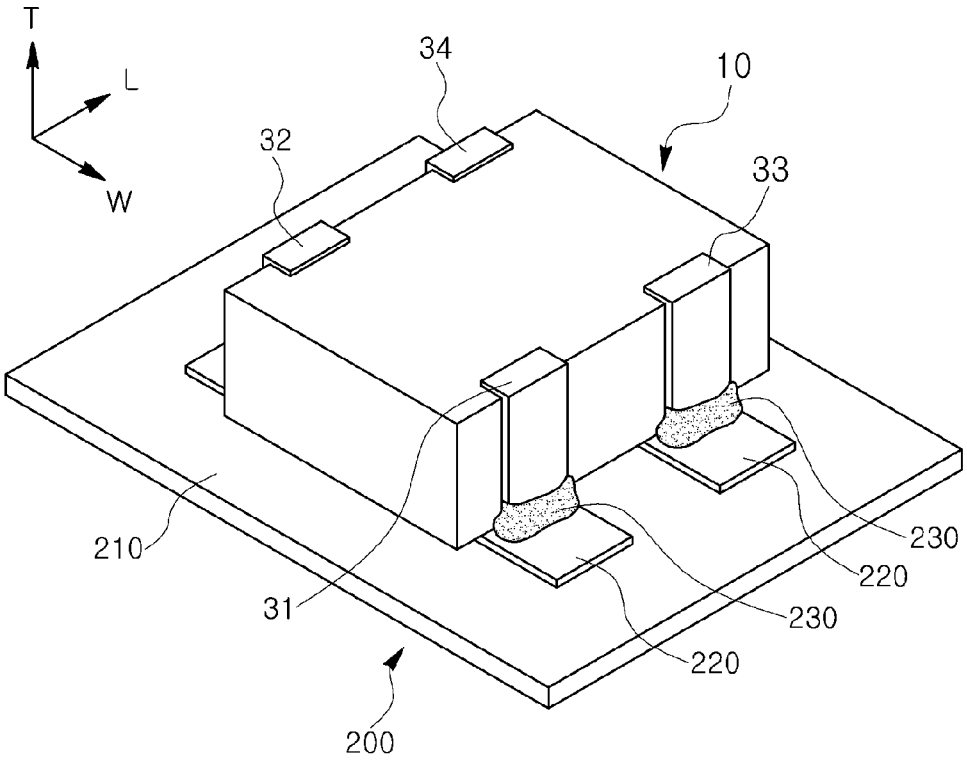
FIG. 6 is a perspective view of a board in which the coil component of FIG. 1 is mounted on a printed circuit board.

FIG. 6 is a perspective view of a board in which the coil component of FIG. 1 is mounted on a printed circuit board.

Referring to FIG. 6, a board 200 having a coil component according to an exemplary embodiment may include the coil component and a printed circuit board 210 on which the coil component is horizontally mounted, and a plurality of electrode pads 220 may be formed to be spaced apart from each other on an upper surface of the printed circuit board 210.

In this case, the coil component may be electrically connected to the printed circuit board 210 by solders 230 in a state in which the first to fourth external electrodes 31 to are positioned to contact the electrode pads 220, respectively.

Except for the description described above, a description of features overlapped with those of the coil component according to the previous exemplary embodiment will be omitted.

As set forth above, according to exemplary embodiments of the present disclosure, two coils positioned in an upper portion of a magnetic body on the basis of the center of the magnetic body in the thickness direction thereof are disposed adjacent to each other while sharing cores, such that coupling coefficient may be increased, and two coils positioned in a lower portion of the magnetic body are disposed in parallel to each other so as to be spaced apart from each other, such that leakage inductance may be increased.

Therefore, leakage inductance and mutual inductance may be adjusted to desired values.

While exemplary embodiments have been shown and described above, it will be apparent to those skilled in the art that modifications and variations could be made without departing from the scope of the invention as defined by the appended claims.

What is claimed is:

1. A coil component comprising:

a magnetic body including a substrate having two cores, first and second coil parts disposed on one surface of the substrate and wound in the same direction, and third and fourth coil parts disposed on the other surface of the substrate to be spaced apart from each other; and first to fourth external electrodes disposed on outer surfaces of the magnetic body and connected to the first to fourth coil parts, wherein the two cores are defined as the center of the third coil part and the center of the fourth coil part, respectively, the two cores are disposed to be spaced apart from each other in a length direction of the magnetic body, and the first and second coil parts have a double coil shape in which two coils are disposed adjacently to each other on an upper surface of the substrate while sharing the two cores, and the third and fourth coil parts are disposed in parallel to each other on a lower surface of the substrate to be spaced apart from each other in the length direction of the magnetic body.

2. The coil component of claim 1, wherein the first and third coil parts are connected to each other through a via electrode.

3. The coil component of claim 1, wherein the second and fourth coil parts are connected to each other through a via electrode.

4. The coil component of claim 1, wherein the first and third external electrodes are input terminals, and the second and fourth external electrodes are output terminals.

5. The coil component of claim 1, wherein the first and second coil parts have the same length.

6. The coil component of claim 1, wherein the first to fourth coil parts contain at least one selected from the group consisting of gold, silver, platinum, copper, nickel, palladium, and alloys thereof.

7. The coil component of claim 1, wherein the substrate is a magnetic substrate.

8. A board having a coil component, the board comprising:

a printed circuit board on which a plurality of electrode pads are provided; and the coil component mounted on the printed circuit board, wherein the coil component includes:

a magnetic body including a substrate having two cores, first and second coil parts disposed on one surface of the substrate and wound in the same direction, and third and fourth coil parts disposed on the other surface of the substrate to be spaced apart from each other; and first to fourth external electrodes disposed on outer surfaces of the magnetic body and connected to the first to fourth coil parts, wherein the two cores are defined as the center of the third coil part and the center of the fourth coil part, respectively, the two cores are disposed to be spaced apart from each other in a length direction of the magnetic body, and the first and second coil parts have a double coil shape in which two coils are disposed adjacently to each other on an upper surface of the substrate while sharing the two cores, and the third and fourth coil parts are disposed in parallel to each other on a lower surface of the substrate to be spaced apart from each other in the length direction of the magnetic body.

9. The board of claim 8, wherein the first and third coil parts are connected to each other through a via electrode.

10. The board of claim 8, wherein the second and fourth coil parts are connected to each other through a via electrode.

11. The board of claim 8, wherein the first and third external electrodes are input terminals, and the second and fourth external electrodes are output terminals.

12. The board of claim 8, wherein the first and second coil parts have the same length.

13. The board of claim 8, wherein the first to fourth coil parts contain at least one selected from the group consisting of gold, silver, platinum, copper, nickel, palladium, and alloys thereof.

14. The board of claim 8, wherein the substrate is a magnetic substrate.

* * * * *